US005926850A

United States Patent [19]

Han

[11] Patent Number: 5,926,850

[45] Date of Patent: Jul. 27, 1999

[54] FIT CAP

[76] Inventor: Cha Rang Han, 92-19 Sung-San Dong, Mapo-Gu, Seoul, Rep. of Korea, 135-080

[21] Appl. No.: 09/184,339

[22] Filed: Nov. 2, 1998

[51] Int. Cl.[6] ..... A42B 1/22

[52] U.S. Cl. ..... 2/183; 2/195.3

[58] Field of Search ..... 2/183, 195.3, 417, 2/418, 181, 195.2

[56] References Cited

U.S. PATENT DOCUMENTS 2,052,123 8/1936 Adamson ..... 2/183

5,615,415 4/1997 Beckerman ..... 2/195.3

*Primary Examiner*—Diana L. Oleksa

*Attorney, Agent, or Firm*—Beehler & Pavitt; Jerry H. Noh

[57] ABSTRACT

The improved fit cap of the present intention fit wearers within a predetermined range of hat sizes. The improved fit cap has a crown member and a brim extending from a front portion. A sweat band having a bottom edge, and a top edge is attached along its lower edge to an interior surface of the crown member. When attached to the crown member, the bottom edge of the sweat band is of a larger circumference than the circumference of the top edge of the sweat band. Furthermore, the sweat band is composed of an unidirectionally stretchable fabric aligned to stretch only along an axis perpendicular to the top and bottom edges of the sweat band.

6 Claims, 2 Drawing Sheets

FIT CAP

BACKGROUND OF THE INVENTION

I. Field of Invention

The present invention relates to sports caps, and particularly to a cap capable of comfortably fitting wearers having various head sizes within a predetermined range.

II. Description of the Prior Art

In order to accommodate the various head sizes of cap wearers, caps have been provided pre-sized in a variety of different sizes. Also, caps have been provided with a size adjustment means in order to accommodate heads of different sizes.

Pre-sized caps provide an ideal custom fit for individual wearers, however, there is a high cost in manufacturing caps in a number of sizes. There is also a high cost for the retailers in having to maintain an inventory of caps in all the available sizes. Thus, a cap having a size adjustment means is ideal in terms of cutting down costs for the manufacturer and the retailer.

The most widely known size adjustment means is a pair of plastic straps hereinafter referred to as snap means. The cap which utilizes this snap means has a semicircular open area forming a gap at the back. The straps are attached at opposite ends of the gap. A first strap has a plurality of holes, and a second strap has a plurality of snaps designed to engage the holes of the first strap. The cap with the snap means typically accommodates hat sizes from 7 inches to 7¾ inches.

Another type of adjustment means is a pair of straps hereinafter referred to as VELCRO hook and loop fastener means. The overall structure and appearance of a cap which utilizes this means is similar to the cap with the snap means. A first strap having a patch of VELCRO loop fastener is attached to one end of the gap, and a second strap having a patch of corresponding VELCRO hook fastener is attached to the opposite end of the gap.

Caps having either the VELCRO hook and loop fastener means or the snap means have similar disadvantages. One common problem is wear and tear. The plastic snaps and the patches of VELCRO hook and loop fasteners tend to wear out with constant use. As these means start to wear down, the straps decrease in their ability to maintain a secure attachment. Also, from the point of aesthetics, a hat having either of these means does not appeal to people having small and large hat sizes. For the person with a small hat size, the hat will fit the wearer along the brim of the hat, however, the crown portion of the hat will appear disproportionately large. For the person with a large hat size, the crown portion of the hat will appear disproportionately small.

Another type of cap is shown in U.S. Pat. No. 5,715,540 issued to Cho. This reference teaches construction of a "Free-size" cap having multiple gore shells forming a crown portion. At least some of the gores are formed from a uniaxially stretchable fabric aligned to stretch only in a peripheral direction, which makes this cap capable of fitting all wearers within a predetermined range of hat sizes. One disadvantage with this cap is that the squeezing effect caused by the peripherally elastic gore creates some discomfort and marks on the forehead or the hair of the wearer, especially in the case of a wearer with a large hat size. Also, in terms of aesthetics there tends to be wrinkles on the stretchable gores when the cap is worn by wearers having smaller hat sizes. Furthermore, the composition of the stretchable gore shell of the "Free-size" cap is limited to the specific type of fabric as taught by Cho.

Thus, a cap overcoming the deficiencies of the prior arts is desired. A primary objective of the present invention is to provide a comfortably fitting cap which is aesthetically appealing.

Another objective of the present invention is to provide a comfortably fitting cap which can be worn by different wearers having a hat size within a predetermined range of hat size.

A further objective of the present invention is to provide a comfortably fitting cap the construction of which is not limited to a specific type of fabric.

SUMMARY OF THE INVENTION

The improved fit cap of the present invention eliminates some of the disadvantages of the previously described caps currently known in the art.

The improved fit cap of the present intention provides the look and fit of a custom pre-sized hat while being able to fit wearers within a predetermined range of hat sizes.

The improved fit cap has a crown member and a brim extending from a front portion. The feature allowing the improved fit is a sweat band having a bottom edge, a top edge, and a central portion. The sweat band is attached along its lower edge to the interior surface of the crown member. When attached to the crown member, the bottom edge of the sweat band is of a first predetermined circumference and the top edge is of a second predetermined circumference, and the second circumference is less than the first circumference. The sweat band is composed of an unidirectionally stretchable fabric aligned to stretch only along an axis perpendicular to the bottom and top edges of the sweat band.

The crown member according to the present invention is preferably made in four sizes, small, medium, large, and extra large.

The brim extending from the front portion of the crown member of the present invention is preferably somewhat rigid and shaped like conventional baseball caps.

DETAILED DESCRIPTION OF THE PREFERRED EMBODIMENT

Figure 1:
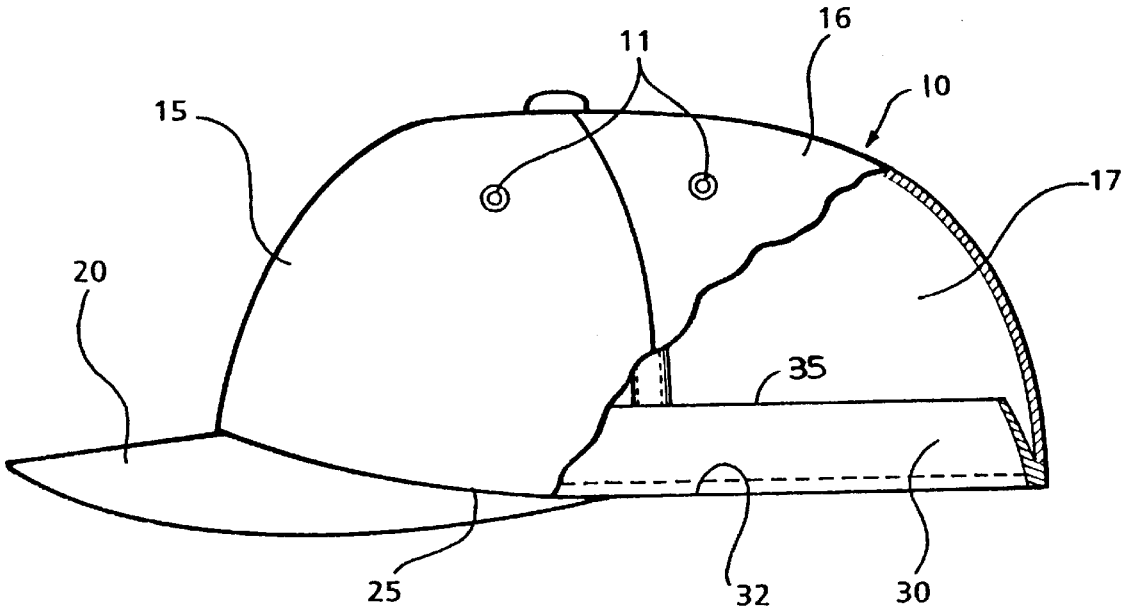
FIG. 1 is a side elevational view of the improved fit cap with a portion of the crown member cut out to show the interior surface.
Figure 2:
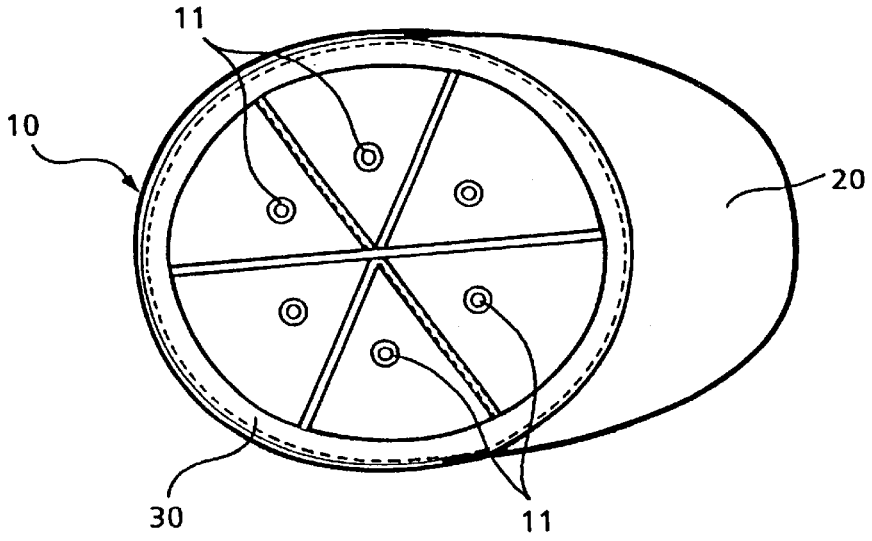
FIG. 2 is a bottom view of the improved fit cap.
Figure 3:
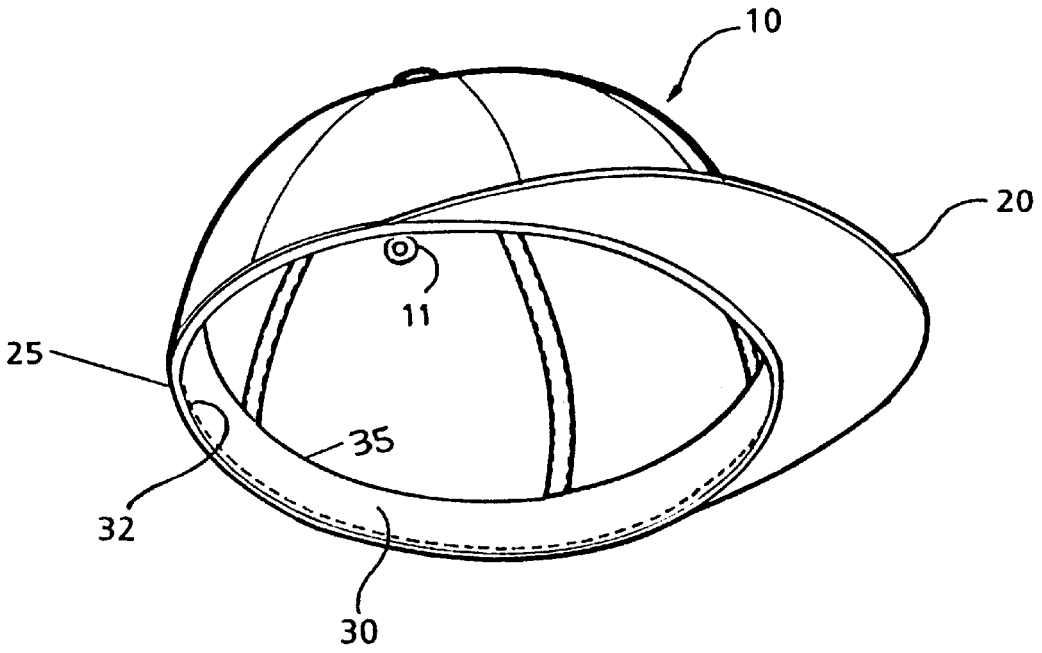
FIG. 3 is a bottom perspective view of the improved fit cap.

FIGS. 1–3 shows the present invention having a crown member 10 made of uniform fabric material. The material is not limited to any specific fabric. The crown member 10 has a front portion 15 from which extends a brim 20. Also, the crown member 10 has an exterior surface 16, an interior surface 17, and a circumferential lower edge 25.

Figure 4:
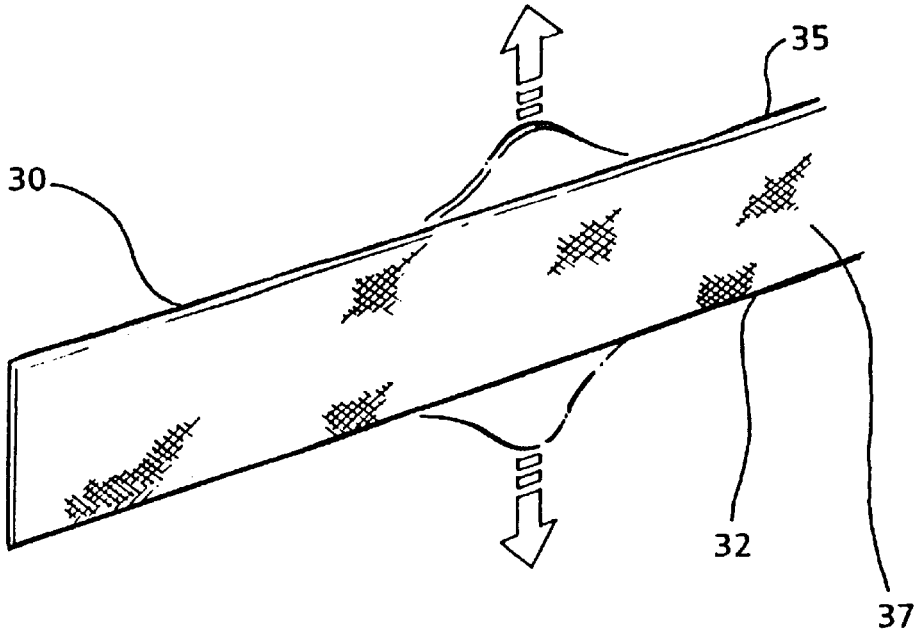
FIG. 4 is side perspective view of a portion of sweat band illustrating the stretching of the sweat band of the improved fit cap.

FIG. 4 shows a sweat band 30 having a bottom edge 32, a top edge 35, and a central portion 37. The sweat band 30 is composed of an unidirectionally stretchable fabric aligned to stretch only along an axis perpendicular to the bottom 32 and top 35 edges of the sweat band 30. As shown in FIGS. 1–3, the sweat band's 30 bottom edge 32 is circumferentially attached to the interior surface of the crown member 10 adjacent the lower edge 25. Also, when attached to the crown member 10, the bottom edge 32 of the sweat band 30 is of a first predetermined circumference and the top edge 35 is of a second predetermined circumference wherein the second circumference is less than the first circumference. The sweat band's 30 top edge 35 and central portion 37 are free and unattached to the crown member 10.

A plurality of orifices 11 extending from the exterior surface 16 to the interior surface 17 can be placed on the crown member 10.

It will be understood that various changes and modification may be made in the above described invention without departing from the meaning and scope of the invention which is limited only by the following claims.

What is claimed is:

1. A cap capable of comfortably fitting wearers within a predetermined range of hat sizes comprising:

a crown member having exterior and interior surfaces, a front portion, and a circumferential lower edge;

a sweat band having a bottom edge, a top edge, and a central portion;

said sweat band being composed of unidirectionally stretchable fabric aligned to stretch only along an axis perpendicular to the bottom and top edges of the sweat band; and, said sweat band's lower edge being circumferentially attached to said interior surface of said crown member adjacent the lower edge.

2. The cap as described in claim 1 wherein said bottom edge of said sweat band is of a first predetermined circumference, said top edge is of a second predetermined circumference, and said second circumference is less than the first circumference.

3. The cap as described in claim 2 wherein said sweat band's top edge and central portion are free and unattached to said crown.

4. The cap as described in claim 1 further comprising a brim extending from said front portion of said crown member.

5. The cap as described in claim 1 further comprising a plurality of orifices disposed on said crown member extending from said exterior surface to said interior surface of said crown member.

6. The cap as described in claim 1 wherein the crown member is composed of uniform fabric material.

* * * * *